US005782376A

United States Patent [19]

Brauner et al.

[11] Patent Number: 5,782,376

[45] Date of Patent: Jul. 21, 1998

[54] THERMOFORMED PLASTIC CONTAINERS AND THEIR METHOD OF MANUFACTURE

[75] Inventors: Arne H. Brauner, Minnetonka; Donald P. Messer, Eden Prairie, both of Minn.

[73] Assignee: General Mills, Inc., Minneapolis, Minn.

[21] Appl. No.: 523,671

[22] Filed: Sep. 5, 1995

Related U.S. Application Data

[63] Continuation-in-part of Ser. No. 39,499, May 25, 1995, Pat. No. Des. 369,971.

[51] Int. Cl.[6] ..... B65D 23/00

[52] U.S. Cl. ..... 220/669; 220/675

[58] Field of Search ..... 220/669, 675, 220/4.5, 406; D9/428

[56] References Cited

U.S. PATENT DOCUMENTS

| | | | |
|---|---|---|---|
| D. 313,556 | 1/1991 | Smith | D9/425 |
| D. 317,567 | 6/1991 | Lane, Sr. | D9/425 |
| D. 339,522 | 9/1993 | Zoss | D9/425 X |
| D. 369,971 | 5/1996 | Brauner et al. | D9/428 |
| 2,573,736 | 11/1951 | Scavulio | 220/657 X |
| 3,501,080 | 3/1970 | Govatsos | 229/406 X |
| 4,828,112 | 5/1989 | Vollrath et al. | 220/657 X |
| 5,054,617 | 10/1991 | Young et al. | 206/515 X |
| 5,101,990 | 4/1992 | Krishnakumar et al. | 220/675 X |
| 5,203,836 | 4/1993 | Brazis et al. | 220/659 X |
| 5,224,623 | 7/1993 | La Fleur | 220/675 X |

*Primary Examiner*—Steven M. Pollard

*Attorney, Agent, or Firm*—L. MeRoy Lillehaugen; John A. O'Toole; Alan D. Kamrath

[57] ABSTRACT

A thermoformed plastic container (10) is disclosed including a sidewall (18) formed by the intersection of three portions (20, 22, 24) formed by curved planar surfaces. The bottom portion (20) is generally frustoconical in shape having cross sections corresponding to the periphery of the bottom (16) and of an increasing size linearly dependent on increased spacing from the bottom (16). The upper portion (24) is generally frustoconical in shape having oval cross sections and of a decreasing size linearly dependent on increased spacing from the flange (12). The middle portion (22) is generally frustoconical in shape having oval cross sections different from that of the bottom and upper portions (20, 24) and of an increasing size linearly dependent on increased spacing from the bottom (16). The portions (20, 22, 24) intersect at curved intersection lines (26, 32) having varying spacing from the bottom (16). The bottom portion (20) creates a chamfered edge which is larger at the longitudinal front and back of the container (10) and which is narrower at the lateral sides of the container (10). The use of curved planar surfaces in creating the sidewall (18) is advantageous in allowing computer analysis in easily and quickly fabricating prototypes for evaluation.

17 Claims, 1 Drawing Sheet

THERMOFORMED PLASTIC CONTAINERS AND THEIR METHOD OF MANUFACTURE

CROSS REFERENCE

The present application is a continuation-in-part of application Ser. No. 29/039,499 filed May 25, 1995 now U.S. Pat. No. Des. 369,971.

BACKGROUND

The present invention generally relates to containers and their method of manufacture, particularly to thermo-formed plastic containers and their method of manufacture, and specifically to thermoformed plastic containers which are taller and which are less prone to thinning out during their manufacture.

In producing hollow volumes such as refrigerated food containers, a sheet of plastic is thermoformed to form the volume and specifically, the plastic sheet is heated and then drawn into a cavity such as by vacuum and/or pressure. As the sheet is drawn into the cavity, the thickness of the portion of the sheet drawn into the cavity is reduced as the material in the sheet is stretched into the cavity. It can then be appreciated that the amount of reduction of thickness is dependent on the depth of the draw or in other words the height of the volume, with the deeper the draw the more the reduction of thickness. Thus, the thickness of the stock sheet material must be selected according to the depth of the draw to decrease the prospect of thinning out where the material forming the volume becomes too thin to sustain the rigors of distribution. The problem of thinning out is especially prone at corners where the material rapidly changes angles in the volume such as at the bottom and sidewall of a cup-shaped container. It can be appreciated that increased thickness stock sheet material increases material and formation costs.

Additionally, it is often desired to make prototypes for evaluation of form, function, and like features. Prototypes of hollow volumes intended to be formed by thermoforming and having relatively complex shapes can be relatively expensive to make and often involves creation of actual molds including the desired shaped cavity. Thus, development of alternate designs was often time-consuming and expensive. Also, analyzation by computer programs of complex shaped volumes was not possible.

Thus, a need exists for improved thermoformed containers and their method of manufacture which maximizes the depth of the draw while minimizing the thickness of the stock sheet material needed while still avoiding the problem of thinning out. Further, a need exists for improved containers having relatively complex shapes but which lend themselves towards analysis by computer and which can be quickly and easily prototyped for evaluation.

SUMMARY

These needs and other problems in the field of thermoformed plastic containers are solved by providing a container, in the preferred form, including first and second portions having cross sections of different shapes, formed of curved planar surfaces, and interconnected in a first curved intersection line having varying spacing from the periphery of a bottom interconnected to the first portion, with the first portion having cross sections corresponding to the periphery of the bottom and of an increasing size with increased spacing from the bottom.

In a preferred aspect of the present invention, the first portion acts as a chamfered edge between the second portion and the bottom to provide protection against thinning out at the interconnection of the sidewall to the bottom, and in the most preferred form to provide greater protection in the longitudinal direction when the second portion has a shape having a longitudinal direction which is greater than the lateral direction.

These and further aspects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
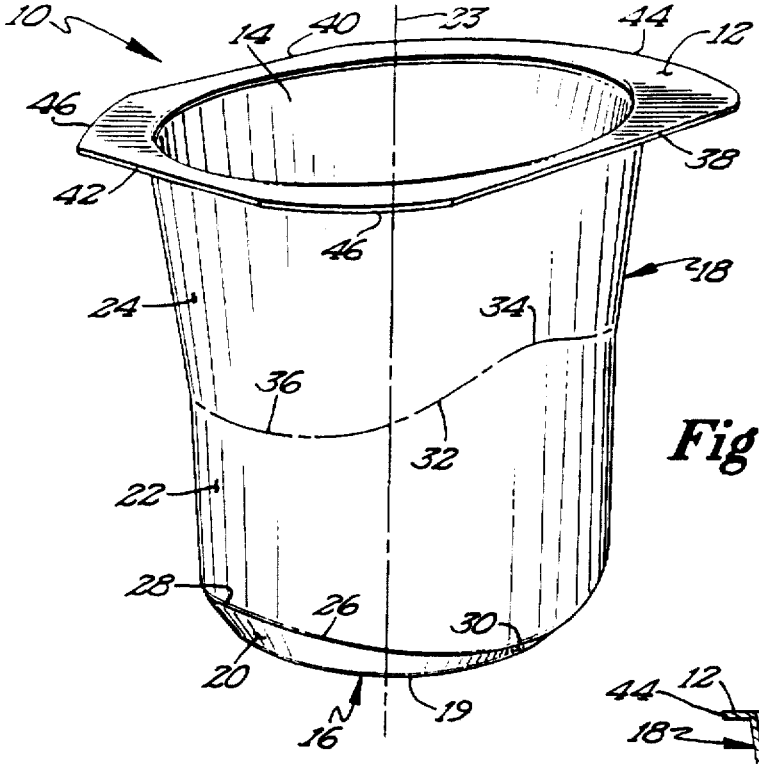
FIG. 1 shows a perspective view of a refrigerated food container formed utilizing methods according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "end", "edge", "side", "front", "back", "length", "width", "outer", and similar terms are used herein, it should be understood that these terms have reference only to the structure shown in the drawings as it would appear to a person viewing the drawings and are utilized only to facilitate describing the invention.

DESCRIPTION

A hollow volume in the most preferred form of a refrigerated food container according to the preferred teachings of the present invention is shown in the drawings and generally designated 10. In the most preferred form, container 10 is utilized for holding single servings of yogurt. Generally, container 10 includes a generally planar, annular flange 12 having a thickness generally equal to the uniform thickness of the stock sheet thermoplastic material utilized to form container 10. The inner edge of flange 12 defines an upper opening 14 which in the most preferred form is generally oval shaped for ease of introducing a spoon through opening 14 and into the hollow volume. In the most preferred form, opening 14 has a longitudinal extent which is generally 120% of the lateral extent. Flange 12 is utilized to adhesively receive a suitable closure layer on the upper surface thereof and which extends over and closes opening 14 and for abutment with suitable provisions in a carton which holds a plurality of such containers 10.

Container 10 further includes a generally planar base panel or bottom 16 which is parallel to and spaced from flange 12. In the most preferred form, bottom 16 has a periphery which is generally circular in shape and having a diameter which is slightly less than the lateral extent of opening 14 and in the most preferred form is generally 90% of the lateral extent of opening 14. In the most preferred form, bottom 16 may include a circular standoff ridge 15 formed during thermoforming of container 10. Ridge 15 is located radially inwardly and concentrically within the outer periphery of bottom 16 to define a planar, annular portion 19 extending between the periphery of bottom 16 and ridge 15. Ridge 15 acts as a pilot in stacking and partially nesting containers 10 on a lower carton including other containers 10 to aid in prevention of undesired movement from a stacked condition. Bottom 16 can also include a central dome-shaped portion 17 located radially inward and concentrically within the outer periphery of bottom 16 and of circular standoff ridge 15 and formed during thermoforming of container 10. A planar, annular portion 29 extends between ridge 15 and the outer periphery of dome-shaped portion 17.

Container 10 further includes a sidewall 18 which is generally cylindrical shaped and in the most preferred form tapers toward bottom 16 and has a generally frustoconical shape. Sidewall 18 according to the preferred teachings of the present invention is formed by the intersection of three curved planar surfaces of different cross sections. A curved planar surface is one which when cut along a height dimension can be unrolled or opened out into a planar piece without distortion or in other words is formed by a flat piece which has been curved and its ends interconnected to form a loop or annular member. In particular, sidewall 18 includes a bottom portion 20 intersecting and interconnecting with bottom 16, a middle portion 22 intersecting and interconnecting with bottom portion 20, and an upper portion 24 intersecting and interconnecting with and located between middle portion 22 and flange 12. It should be appreciated that curved planar surfaces of different cross sections intersect in a curved intersection line hereinafter referred to as a spline.

Bottom portion 20 is generally frustoconical shaped having cross sections corresponding to the periphery of bottom 16 which is generally circular in the most preferred form and of a size equal to the periphery of bottom 16 at its intersection and interconnection and of a linearly increasing size dependent on increased spacing from bottom 16. In the most preferred form, bottom portion 20 extends at an angle 21 in the order of 150° outwardly from bottom 16 or in other words 60° from the height axis 23 of container 10. It can then be appreciated that bottom portion 20 acts as a chamfered edge between sidewall 18 and bottom 16 to reduce the prospect of thinning out at the intersection of bottom 16 and sidewall 18 that could occur if the intersection were at a sharp angle such as 90° to bottom 16.

Upper portion 24 is generally frustoconical shaped having oval cross sections different from the shape of the cross sections of portion 20 and of a size generally equal to opening 14 at its intersection and interconnection to flange 12 and of a decreasing size linearly dependent on increased spacing from flange 12 and of an increasing size linearly dependent on increased spacing from bottom 16. In the most preferred form, upper portion 24 extends inwardly at an angle 25 in the range of 5° to 8° from height axis 23 of container 10.

Middle portion 22 is generally frustoconical shaped having oval cross sections different from the shape of the cross sections of portions 20 and 24 and of a decreasing size linearly dependent on increased spacing from flange 12 and of an increasing size linearly dependent on increased spacing from bottom 16. In the most preferred form, middle portion 22 extends at an angle 27 less than angle 25 of upper portion 24 from height axis 23 of container 10 and in the most preferred form in the range of 2°–3° from height axis 23 of container 10. Further, the oval cross sections of middle portion 22 in the most preferred form are less oval shaped, i.e. the ratio of the shape in the longitudinal direction versus the lateral direction being smaller and more cylindrical shaped than the oval cross sections of upper portion 24.

It can then be appreciated that middle portion 22 and bottom portion 20 intersect and interconnect at a curved intersection line or spline 26 having varying spacing from the periphery of bottom 16 with its greatest spacing from the periphery of bottom 16 at its high points 28 in the longitudinal direction at the longitudinal front and back of container 10 and its smallest spacing from the periphery of bottom 16 at its low points 30 in the lateral direction at the lateral sides of container 10. Similarly, middle portion 22 and upper portion 24 intersect and interconnect at a curved intersection line or spline 32 having varying spacing from the periphery of bottom 16 with its greatest spacing from the periphery of bottom 16 at its high points 34 in the lateral direction at the lateral sides of container 10 and its smallest spacing from the periphery of bottom 16 at its low points 36 in the longitudinal direction at the longitudinal front and back of container 10.

In the most preferred form, bottom 16 and sidewall 18 are symmetrical about the longitudinal axis and also symmetrical about the lateral axis. Further, sidewall 18 of container 10 generally tapers from opening 14 to the periphery of bottom 16 creating container 10 having a greater overall height than a similar container having the same size opening as opening 14 but with non-tapering sidewalls. Thus, container 10 according to the preferred teachings of the present invention can be formed, filled, and sealed in the same packaging line as prior shorter containers of generally the same volume.

In production of containers 10 according to the teachings of the present invention, the stock sheet thermoplastic material is extended over a cavity, with at least the portions of the material extending over the cavity being heated. It can then be appreciated that the cavity includes components corresponding to opening 14, bottom 16, and portions 20, 22, and 24 of container 10 desired to be produced. With the portions of the material located outward of the opening of the cavity and forming flange 12 being clamped or otherwise held, the portions of the material extending over the opening of the cavity is drawn into the cavity such as by vacuum and/or pressure and against the sidewall and bottom of the cavity to form container 10. In this regard, a plug assist technique can be utilized before or during the drawing step to pull material located outward of the opening of the cavity into the cavity to provide increased material for forming sidewall 18 and bottom 16.

Figure 2:
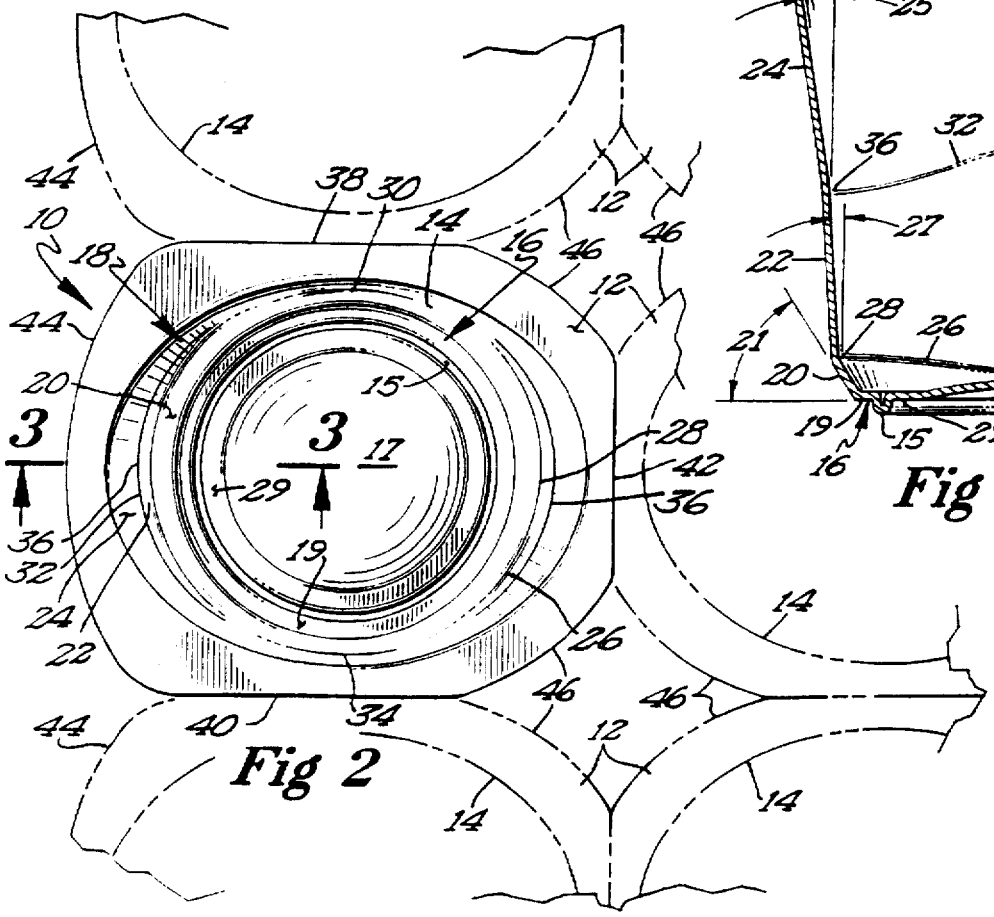
FIG. 2 shows a top plan view of the refrigerated food container of FIG. 1, with portions of other inter-connected containers shown in phantom.
Figure 3:
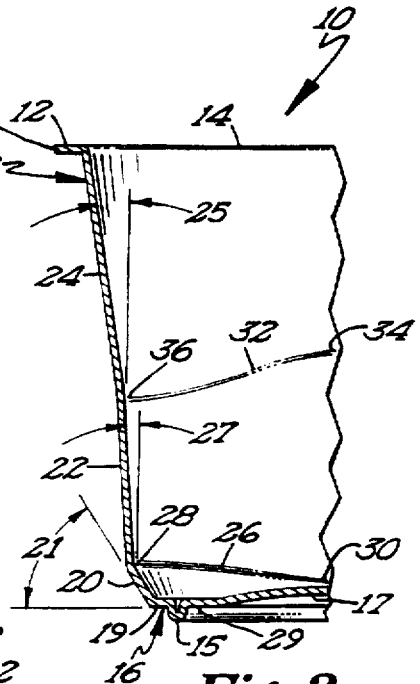
FIG. 3 shows a partial, cross-sectional view of the refrigerated food container of FIG. 1 according to section line 3—3 of FIG. 2.

In the most preferred form, multiple containers 10 are integrally produced in arrays including two columns and multiple rows. In this regard, flange 12 includes first and second, outer, parallel, straight, side edges 38 and 40 which are parallel to the longitudinal axis of container 10. Flange 12 further includes an outer, straight, front edge 42 which is parallel to the lateral axis of container 10 and arranged perpendicular to edges 38 and 40. An outer, arcuate rear edge 44 extends between edges 38 and 40 on the side of flange 12 opposite to edge 42. In the most preferred form, arcuate corner edges 46 extend between the front ends of edges 38 and 40 and front edge 42. As illustrated in FIG. 2, in each row of the array of containers 10, edges 42 are interconnected together with a break-away connection and with edges 44 located on the outside of the array. Similarly, in each column of the array of containers 10, edges 38 and 40 are interconnected together with a break-away connection aside from the first container 10 in the column which has edge 38 free and the last container 10 in the column which has edge 40 free. Material between edges 46 of adjacent containers 10 in the array of containers 10 can be removed for ease of separation. It can then be appreciated that production in arrays is advantageous in filling, handling, and marketing containers 10, with filled, individual containers 10 being broken off by the consumer when desired. Flange 12 of the preferred form is then believed advantageous in fabricating containers 10 in arrays according to the preferred teachings of the present invention.

Due to the varying spacing of spline 26 from the periphery of bottom 16, portion 20 creates a chamfered edge which is larger at the longitudinal front and back of container 10 and which is narrower at the lateral sides of container 10. It can then be appreciated that due to the larger difference in dimensions between opening 14 and the periphery of bottom 16 in the longitudinal direction than the lateral direction, the stock sheet thermoplastic material must stretch farther in the longitudinal direction than the lateral direction and thus is more prone to thinning out, especially at the intersection of sidewall 18 with bottom 16 at the longitudinal front and back of container 10. Due to the preferred teachings of the present invention, container 10 includes the chamfered edge which is larger at the longitudinal front and back to reduce the prospect of thinning out where it has most likely occurred on containers prior to the present invention. The chamfered edge is smaller at the lateral sides of container 10 and thus provides less reduction in the risk of thinning out at those areas but in those areas the risk of thinning out is not as great as in the longitudinal directions.

Due to the differing sizes and shapes of portions 22 and 24, the lateral sides of sidewall 18 between opening 14 and points 30 and 34 are generally linear with only a very slight change of direction at spline 32 whereas the longitudinal front and back of sidewall 18 between opening 14 and points 28 and 36 have a pronounced change of direction at spline 32. In the most preferred form, the height between bottom 16 and point 28 is approximately 10% and between points 28 and 36 is approximately 40% of the height of container 10. The height between bottom 16 and point 30 is less than one-third of the height between bottom 16 and point 28 and approximately 3% of the height of container 10.

It can then be appreciated that splines 26 and 32 can be designed to maximize the height of container 10, to improve material distribution to reduce the problem of thinning out, to leave a convenient place for a company logo or the like to be embossed on one or both lateral sides of container 10, and to have like features while creating an aesthetically pleasing appearance for container 10.

Another major advantage of the use of curved planar surfaces is the ability to fabricate prototype containers for the purposes of insuring that container 10 meets the desired design criteria. In particular, many CAD software programs include a feature that is derived from aircraft design, specifically, a sub routine which will translate three-dimensional, curved planar surface shapes such as the fuselage and wings into flat patterns for fabrication from sheet metals. The present invention is then a recognition that this technology developed for another field can be taken advantage of in the field of thermoforming containers of the present invention with synergistic results. Specifically, each component of container 10, i.e. flange 12, bottom 16, and portions 20, 22, and 24, can be cut from planar material such as stiff paper or paperboard and glued or otherwise assembled together. Thus, prototype containers 10 can be quickly and inexpensively fabricated for evaluation of form, function, and like functions and for experimental modifications without requiring fabrication of mold cavities as would be required if non-planar surfaces were utilized such as would be required for fabricating prototypes having dome or semispherical shapes. Additionally, development of alternative designs can be quickly and inexpensively generated.

Now that the basic teachings of the present invention have been explained, many extensions and variations will be obvious to one having ordinary skill in the art. For example, although container 10 according to the most preferred form of the present invention is formed including several unique features producing synergistic results, such features could be utilized singly and/or in other combinations according to the teachings of the present invention.

Similarly, although flange 12 has been shown and described in the most preferred form of the present invention as including a shape believed to be especially advantageous for fabrication in arrays, flange 12 can have other outer shapes including but not limited to rectangular according to the teachings of the present invention.

Likewise, portions 20, 22, and 24 can be formed of other curved planar surfaces having different cross sections to form and define sidewall 18 of container 10 according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Container comprising, in combination: a generally planar bottom having a periphery; a first portion interconnected to the periphery of the bottom and having cross sections of a shape corresponding to the periphery of the bottom, with the first portion formed from a curved planar surface, with the cross sections of the first portion being of an increasing size with increased spacing from the bottom; and a second portion interconnected to the first portion and having cross sections of a shape different than the shape of the cross sections of the first portion, with the second portion formed from a curved planar surface, with the first and second portions being interconnected in a first curved intersection line having varying spacing from the periphery of the bottom.

2. The container of claim 1 further comprising, in combination: a third portion interconnected to the second portion and having cross sections of a shape different than the shape of the cross sections of the second portion, with the third portion formed from a curved planar surface, with the second and third portions being interconnected in a second curved intersection line having varying spacing from the periphery of the bottom.

3. The container of claim 2 wherein the periphery of the bottom is generally circular in shape and wherein the cross sections of the second portion are generally oval in shape having a longitudinal direction which is greater than the lateral direction, with the first curved intersection line having the greatest spacing from the periphery of the bottom in the longitudinal direction and the smallest spacing from the periphery of the bottom in the lateral direction.

4. The container of claim 3 wherein the second curved intersection line has the greatest spacing from the periphery of the bottom in the lateral direction and has the smallest spacing from the periphery of the bottom in the longitudinal direction.

5. The container of claim 3 wherein the cross sections of the third portion are generally oval in shape, with the ratio of the shape in the longitudinal direction versus the lateral direction of the third portion being larger than for the second portion.

6. The container of claim 2 wherein the sizes of the cross sections of the second portion have an increasing size with increased spacing from the bottom, and wherein the sizes of the cross sections of the third portion have an increasing size with increased spacing from the bottom.

7. The container of claim 6 further comprising, in combination: an annular, planar flange, with the third portion being interconnected to the flange in an opening, with the flange being parallel to the bottom.

8. The container of claim 7 wherein the annular, planar flange includes first and second, outer, parallel, straight, side edges parallel to the longitudinal direction and an outer, straight front edge parallel to the lateral direction, with the side and front edges being interconnected with the side and front edges of another container with a break-away connection to integrally hold containers in an array.

9. The container of claim 8 wherein the annular, planar flange further includes first and second arcuate corner edges extending between the first and second side edges and the front edge.

10. The container of claim 9 wherein the annular, planar flange further includes an outer, arcuate, rear edge extending between the first and second side edges opposite to the front edge.

11. The container of claim 1 wherein the bottom includes an annular ridge located radially inward of the periphery, with the annular ridge acting as a pilot in stacking and nesting of the containers.

12. The container of claim 11 wherein the annular ridge has a shape corresponding to the periphery and is located concentrically within the periphery.

13. The container of claim 11 wherein the bottom includes a central dome-shaped portion located radially inward of the annular ridge.

14. The container of claim 1 wherein the sizes of the cross sections of the second portion have an increasing size with increased spacing from the bottom.

15. The container of claim 14 wherein the first portion extends at an angle in the order of 150° outwardly from the bottom to act as a chamfered edge between the second portion and the bottom to reduce the prospect of thinning out at the interconnection of the first portion to the periphery of the bottom.

16. The container of claim 15 wherein the periphery of the bottom is generally circular in shape and wherein the cross sections of the second portion are generally oval in shape having a longitudinal direction which is greater than the lateral direction, with the first curved intersection line having the greatest spacing from the periphery of the bottom in the longitudinal direction and the smallest spacing from the periphery of the bottom in the lateral direction to provide greater protection against thinning out in the longitudinal direction.

17. The container of claim 1 wherein the bottom, the first portion, and the second portion are formed by a sheet of thermoplastic material having a substantially uniform thickness and thermoformed to form a volume.

* * * * *